United States Patent [19]

Worthy

[11] 4,287,907

[45] Sep. 8, 1981

[54] FUEL FEEDING SYSTEM FOR AIRCRAFT

[76] Inventor: Howard G. Worthy, 6060- 22nd Ave. SW., Naples, Fla. 33942

[21] Appl. No.: 65,723

[22] Filed: Aug. 10, 1979

[51] Int. Cl.[3] ..... F02M 37/00

[52] U.S. Cl. ..... 137/255; 137/554; 137/557; 137/625.47

[58] Field of Search ..... 137/255, 256, 263, 266, 137/557, 554, 625.41, 625.42, 625.46, 625.47

[56] References Cited

U.S. PATENT DOCUMENTS

| | | | |
|---|---|---|---|
| 2,146,729 | 2/1939 | Gavin | 137/263 X |
| 2,550,917 | 5/1951 | Drapean | 137/263 |
| 3,547,141 | 12/1970 | Alexander | 137/263 |
| 3,643,677 | 2/1972 | Bezlecter | 137/113 |

*Primary Examiner*—Alan Cohan

*Attorney, Agent, or Firm*—Alfred E. Wilson

[57] ABSTRACT

Fuel in aircrafts is commonly stored in a pair of tanks, identified as right and left tanks, and a fuel selector valve is provided by the present invention to selectively feed fuel to the aircraft engine from either tank, and alternatively from both tanks simultaneously. When the fuel selector valve is in a fuel feed position, a white light is illuminated, as fuel flows to the engine, a green light is also illuminated. A timer is in electrical circuit with the tanks and is activated and manually set to a predetermined time setting to sound an alarm just prior to depletion of fuel in the tank in use to warn the operator to switch to the other tank. If for any reason, a tank runs dry while in use or fuel stops flowing or decreases in volume the green light will go out and a red light will be energized along with an audible warning, such as the sound of a buzzer, to enable the operator to switch to a reserve tank commonly provided with approximately ten minutes of fuel for the engine.

8 Claims, 4 Drawing Figures

FUEL FEEDING SYSTEM FOR AIRCRAFT

BACKGROUND OF THE INVENTION

This invention pertains to a fuel feeding system for aircraft and more particularly to a system of this nature including selector control means for the feeding of gasoline to the aircraft engine as well as both visual and audible indicator means to keep the operator informed at all times of the prevailing state of the fuel supply including the feed thereof to the aircraft engine relative to the various fuel supply tanks.

Therefore, one of the principal objects of the present invention is to provide a manual selector valve operably connected to both a right and left fuel storage tank whereby the fuel may be selectively delivered from either or both tanks to the engine.

A further object of the invention is to provide a first visual indicator means to identify the fuel tank or tanks currently in use.

Another object of the invention is to provide a second visual indicator means to confirm the proper flow of fuel from the tank or tanks to the engine.

Yet another object of the invention is to provide a timer means, including an audible signal means, to be manually set to inform the operator of the proper time to switch the flow of fuel from one tank to the other.

A still further object of the invention is to provide a third visual indicator means to indicate an interruption in the fuel flow or an insufficient flow of fuel from one or both tanks to the engine.

Another object of the invention is to provide an audible signal means to operate in conjunction with the third visual indicator means.

DESCRIPTION OF A PREFERRED EMBODIMENT

Figure 2:
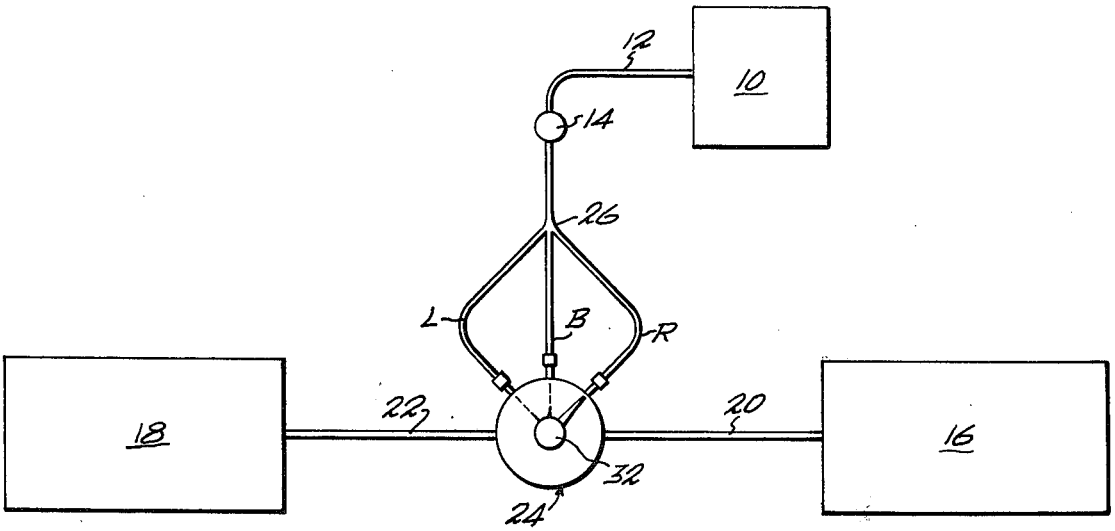
FIG. 2 is a schematic illustration of the arrangement of various components of the present invention relative to an aircraft engine and right and left fuel tanks associated therewith.

With reference to the drawings, in which like reference characters designate like or corresponding parts through the various views and with particular reference to FIG. 2, an aircraft engine is indicated generally at 10 with a fuel line portion 12 including a fuel pump 14 connected therein. Right and left fuel tanks are indicated at 16, 18 with respective fuel line portions 20, 22 extending therefrom into connection at diametrically opposed sides of a fuel selector valve 24.

From valve 24, three fuel line portions extend into a common connection at 26 with fuel line portion 12. A fuel line portion identified R to feed fuel to the engine 10 from the right tank 16, a fuel line portion L from the left tank, and a fuel line portion B from both the left and right tanks. It should be noted that the portion B is omitted if the device is used to control the flow of fuel only on an individual basis from the right and left tanks 16, 18.

With reference to the selector valve 24, the fuel line portions 20 and 22 connect in a diametrically opposed relation to an annular valve housing 28. The fuel line portions R, L and B connect to housing 28 at forty-five degree angles therebetween. It should be noted that the above defined angles are not intended as a limitation, but are intended to illustrate one preferred embodiment.

Figure 3:
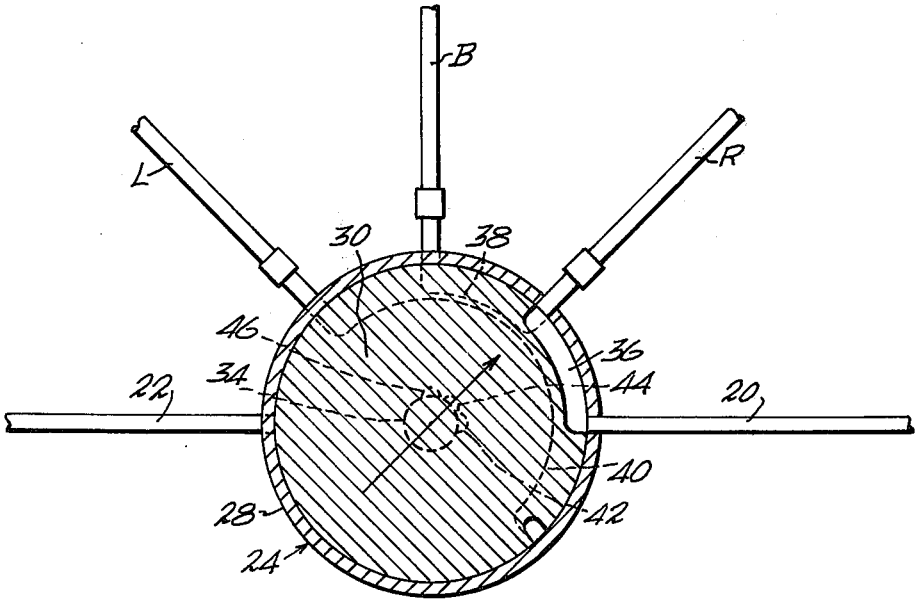
FIG. 3 is a semi-schematic sectional view of a rotary fuel control valve of the present invention.

The rotary valve body 30 includes an exterior positioning and indicator knob 32, FIG. 2, and a lower axially extending stem portion 34, FIG. 3. Three arcuate valve slots 36, 38, and 40 are provided in various levels in the peripheral surface of the valve body 30. The first arcuate slot 36 is designed to communicate between right tank line portion 20 and the fuel line portion R to the engine 10 with the knob 32 in the first position, FIG. 2. In a second position, upon rotation of valve body 30 by knob 32 through 90 degrees in a counterclockwise direction, the slot 38 communicates between left tank line portion 22 and line portion L to the engine 10. Counterclockwise rotational movement through 45 degrees provides communication by means of slot 40 between both fuel line portions 20, 22 and the fuel line portion B to the engine 10. In one form, the arcuate slot 40 and line portion B may be omitted to provide a device that provides a selection between the right or left tank only, to feed fuel to the engine 10 through respective fuel line portions R or L.

Figure 4:
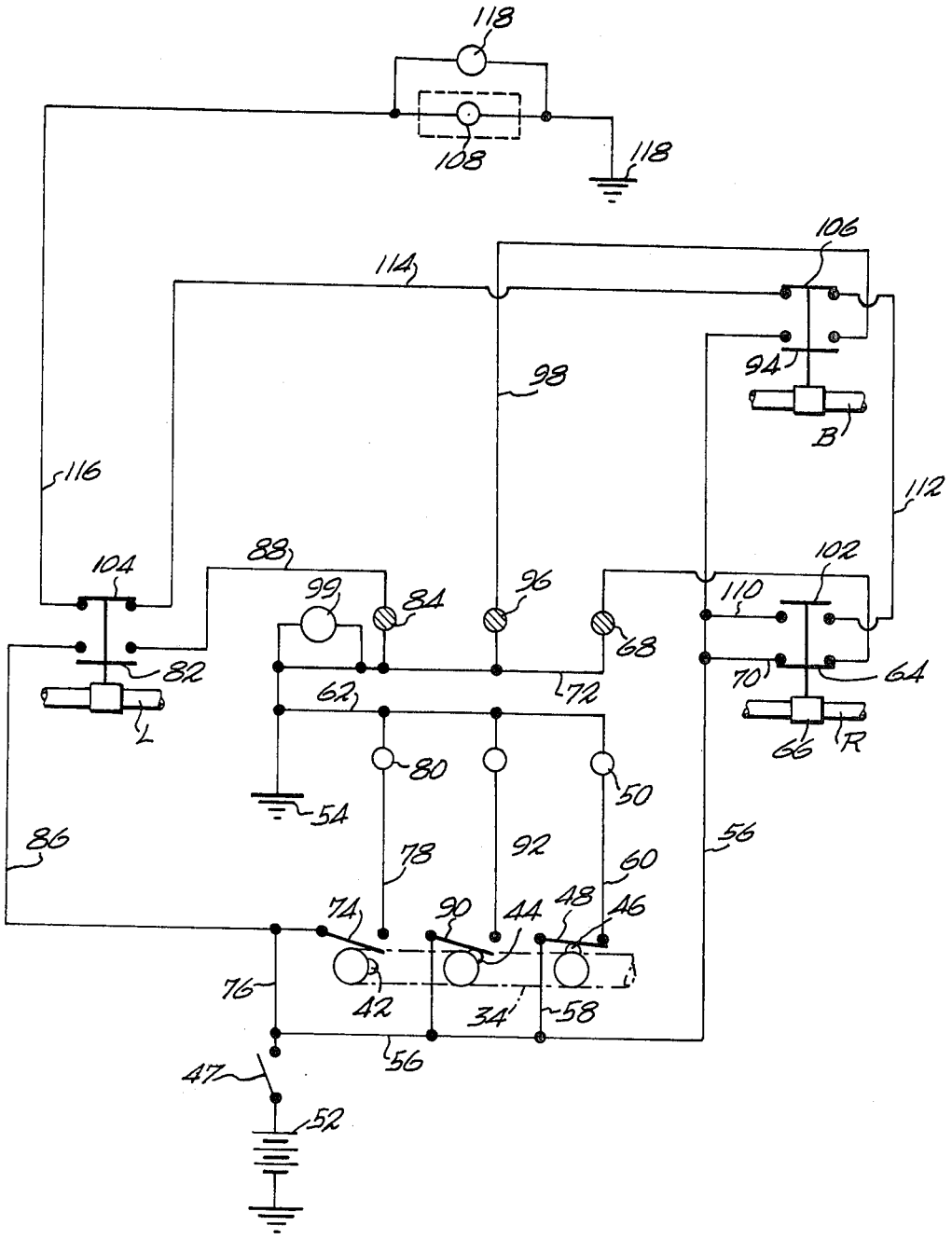
FIG. 4 is a typical wiring schematic utilized in the present invention.

With particular reference to FIGS. 3 and 4, the stem 34 is provided with three nodes 42, 44 and 46 in different elevations.

As illustrated in FIG. 4, the position of node 46 corresponding with the rotary valve position of FIG. 3, and with a main on-off switch 47 closed, said node 46 closes a switch 48 to illuminate a first white indicator light 50 from a source such as battery 52 to a ground 54 through leads 56, 58, 60 and 62 to indicate the fuel feed node from right tank 16. As a result, a pressure responsive switch 64 is operated as by a suitable diaphram in fuel line portion R as at 66 to complete a circuit through a first green light 68 from battery 52 through leads 56, 70 and 72 to ground 54, to confirm a fuel flow.

In like manner, in a fuel feed mode from the left tank, the node 42 closes switch 74 from battery 52 through leads 76, 78 and 62 to ground 54 to illuminate a second white light 80. A second pressure responsive switch 82 closes to indicate a fuel flow through fuel line L by illuminating a second green light 84 by way of leads 76, 86 and 88 to ground 54.

In a fuel feed mode from both tanks, the node 44 closes switch 90 from battery 52 through leads 56, 92 and 62 to ground 54. Switch 94 closes in response to the fuel flow in fuel line portion B to illuminate the third green light 96 through leads 56, 98 and 72 to ground 54. A timer 99 is connected in lead 72 from green lights 68, 84 and 96 for activation when any one of the three fuel feed modes are initiated as above described. The timer may be of a conventional type with selective time setting means 100, FIG. 1, and with an audible signal means to indicate a low fuel condition particularly in the first and second fuel feed modes, above described, the time setting is manually accomplished in accordance with a known time for consumption of the fuel from one tank, for example.

Each of the three switches 64, 82 and 94 include a second contact means 102, 104 and 106 to complete a circuit to a red light 108 when, for any reason, fuel is not flowing through any one of the fuel line portions R, L or B. With no fuel flow, a circuit is completed from battery 52 through leads 56, 110, 112, 114 and 116 to a ground 118. As all three contact means 102, 104 and 106 are in series the red light 108 is not illuminated when any one of said contact means is in an open condition as is contact 102 in FIG. 4. An audible signal such as a buzzer 118 is preferably interposed in lead 116 to co-act with red light 108.

Figure 1:
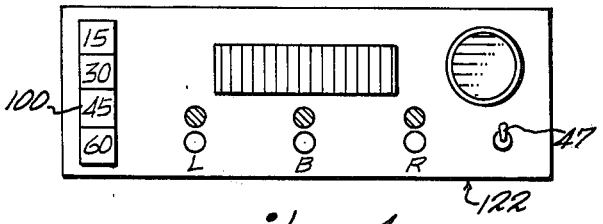
FIG. 1 is a front elevational view of a typical indicator panel employed in the present invention.

FIG. 1 illustrates the various signal lights, audible signal means and timer set means as well as the main on-off switch 47 in a typical panel environment 122 for mounting in an aircraft.

As above stated, the present invention provides for a selective fuel feed from either of the individual right or left tanks 16, 18, or the individual feed in combination with the third mode of simultaneous fuel feed from both tanks 16, 18.

I claim:

1. A fuel feeding system for aircraft having first and second fuel tanks, and including a fuel selector valve movable between first and second fuel feed positions to an existing aircraft engine, a first fuel line portion communicating between the first tank and said valve in said first position, a second fuel line portion communicating between the second tank and said valve in said second position, a third fuel line portion communicating from said valve in said first position to the engine and a fourth fuel line portion communicating from said valve in said second position to the engine, first and second indicator light means of a first distinctive color, first and second electric circuits from a power source such as a battery and connecting respectively to said first color indicator lights, means associated with said selector valve to selectively energize said first color indicator lights through said first and second circuits to visually indicate the valve position relative to said first and second tanks; first and second indicator lights of a second distinctive color; third and fourth electric circuit means from said source, connecting respectively to said second color indicator lights, first and second switch means in said third and fourth circuit means responsive to a flow of fuel respectively in said third and fourth fuel line portions to illuminate one of said second color lights to indicate an actual fuel flow from one of said fuel tanks to the engine as determined by said selector valve position, means for manual operation of said selector valve, a single indicator light of a third distinctive color, and a fifth circuit means connected from said source to said single light, and switch portion on each of said first and second switch means connected in series in said fifth circuit means in a manner so as to complete a circuit to said third color light only when there is no fuel flow from either of said first and second tanks.

2. The system as defined in claim 1 wherein said first distinctive color is white, said second distinctive color is green and said fifth distinctive color is red.

3. The system as defined in claim 1 including a timer in circuit with said second color indicator lights in a manner so as to be energized when one of said second color lights is illuminated.

4. The system as defined in claim 1 including an audible signal means such as a buzzer in series with said third color light.

5. The system as defined in claim 2 wherein said fuel selector valve includes a third position to provide communication between both of said tanks and the engine through said first and second fuel line portions and a fifth fuel line portion from said valve to the engine.

6. The system as defined in claim 5 including third indicator lights of each of said first and second colors with respective associated electric circuitry from said power source to indicate said valve in said third position, and a flow of the fuel through said fifth fuel line portion.

7. The system as defined in claim 6 wherein said means associated with said selector valve comprises an axial stem portion projecting from a rotatable valve body portion of said valve and a node projecting from said stem portion for each of said three positions, each of said nodes being properly positioned to selectively contact and close a switch in an electric circuit to each of said first color indicator lights.

8. The system as defined in claim 6 wherein said associated circuitry includes a third switch portion connected in series with said first and second switch means switch portions.

* * * * *